US005507626A

United States Patent [19]

Yang

[11] Patent Number: 5,507,626

[45] Date of Patent: Apr. 16, 1996

[54] TELESCOPIC PUMP

[76] Inventor: Hsi-Kung Yang, No. 24, Lane 65, San Chun St., Shu Lin Chen, Taipei Hsien, Taiwan

[21] Appl. No.: 194,693

[22] Filed: Feb. 10, 1994

[51] Int. Cl.[6] ..... F04B 3/00

[52] U.S. Cl. ..... 417/258; 417/266; 417/467

[58] Field of Search ..... 417/467, 468, 417/469, 258, 292, 266, 523

[56] References Cited

U.S. PATENT DOCUMENTS

| | | | |
|---|---|---|---|
| 842,142 | 1/1907 | Funck | 417/258 |
| 1,381,115 | 6/1921 | Gassenhube | 417/258 |
| 1,414,283 | 4/1922 | Jewell | 417/262 |
| 1,424,928 | 8/1922 | McClelland | 417/258 X |
| 1,447,964 | 3/1923 | Coleman | 417/553 |
| 1,481,070 | 1/1924 | Shevlin | 417/258 X |
| 1,491,388 | 4/1924 | Foster | 417/468 |
| 1,539,486 | 5/1925 | Holstein | 417/258 |

FOREIGN PATENT DOCUMENTS

| | | | |
|---|---|---|---|
| 625848 | 8/1927 | France | 417/266 |

*Primary Examiner*—Richard E. Gluck
*Attorney, Agent, or Firm*—Kirkpatrick & Lockhart

[57] ABSTRACT

A telescopic manual pump has a first cylinder, a second cylinder received in the first cylinder, a third cylinder received in the second cylinder, a piston slidably received in the third cylinder and a stem linked to the piston. The first cylinder defines a nozzle through a first end and an opening through a second end. The second cylinder defines a first opening through a first end, a second opening through a second end and a piston about the second end thereof. A first limit is attached to the second end of the first cylinder for retaining the piston of the second cylinder in the first cylinder. The third cylinder defines a first opening through a first end, a second opening through a second end and a piston about the second end thereof. A second limit is attached to the second end of the second cylinder for retaining the piston of the third cylinder in the first cylinder. The piston has first and second disks spaced from each other. A plurality of holes are defined through the first disk of the piston. A sealing ring is slidably mounted between the first and second disks of the piston. A third limit is attached to the second end of the third cylinder for retaining the piston, which is linked to the stem, in the third cylinder.

5 Claims, 5 Drawing Sheets

TELESCOPIC PUMP

BACKGROUND OF THE INVENTION

The present invention relates to a telescopic pump.

Manual pumps are often used to inflate balls and tires. a conventional type of manual pump has a cylinder. The cylinder has a first end defining a nozzle and a second end defining an opening. A piston has a hub and first and second disks which are formed on the hub in a spaced manner. A plurality of holes are defined through the first disk of the piston. A sealing ring is mounted between the first and second disks of the piston. A limit defines a hub. A stem is inserted through the hub of the limit. The stem is further inserted through a spring. Then, a first end of the stem is attached in the hub of the piston. A second end of the stem is attached to a T-shaped handle. The piston is slidably received in the cylinder. The opening which is defined in the cylinder is limited by means of the limit. Grease is provided on the piston.

As the T-shaped handle is pulled, the piston is moved, by means of the stem, from the first end of the cylinder toward the second end of the cylinder. The sealing ring is thus pushed against the first disk of the piston. The grease provides a sealing effect between the cylinder and the sealing ring and a sealing effect between the sealing ring and the first disk of the piston. However, a gap is defined between the cylinder and the second disk of the piston. Thus, air is allowed to flow through the gap which is defined between the cylinder and the second disk of the piston and further through the holes which are defined through the first disk of the piston. As a result, air is drawn into the cylinder. In the above-mentioned stroke, the spring acts a buffer between the piston and the limit as the former is moved toward the latter. The limit will not be dislodged from the cylinder when the piston impacts against the limit via the spring.

As the handle is pushed, the piston is moved, by means of the stem, from the second end of the cylinder toward the first end of the cylinder. The sealing ring is thus pushed against the second disk of the piston. The grease provides a sealing effect between the cylinder and the sealing ring and a sealing effect between the sealing ring and the second disk of the piston. As air is kept from passing between the cylinder and the sealing ring and between the sealing ring and the second disk of the piston, air is pushed out of the cylinder through the nozzle which is defined through the cylinder.

Obviously, to pump a certain amount of air into a ball for example, fewer strokes of the piston in the cylinder are required if the cylinder is longer. The conflict between a desired greater length of a cylinder to reduce the frequency of strokes and the desired shorter length of a cylinder to achieved a compact size contributes to the inconvenience for a user of the pump. Therefore, there is a long and unfulfilled need for a convenient pump which saves the labor of its user and requires a small storage space.

SUMMARY OF THE INVENTION

It is the primary object of the present invention to provide a labor-saving and compact pump.

The primary object of the present invention is achieved by providing a telescopic pump which has a first cylinder, a second cylinder received in the first cylinder, a third cylinder received in the second cylinder, a piston slidably received in the third cylinder and a stem linked to the piston. The first cylinder defines a nozzle through a first end and an opening through a second end. The second cylinder defines a first opening through a first end, a second opening through a second end and a piston about the second end thereof. A first limit is attached to the second end of the first cylinder for retaining the piston of the second cylinder in the first cylinder. The third cylinder defines a first opening through a first end, a second opening through a second end and a piston about the second end thereof. A second limit is attached to the second end of the second cylinder for retaining the piston of the third cylinder in the first cylinder. The piston has first and second disks spaced from each other. A plurality of holes are defined through the first disk of the piston. A sealing ring is slidably mounted between the first and second disks of the piston. A third limit is attached to the second end of the third cylinder for retaining the piston, which is linked to the stem, in the third cylinder.

For a better understanding of the present invention and objects thereof, a study of the detailed description of the embodiments described hereinafter should be made in relation to the accompanying drawings.

BRIEF DESCRIPTION OF THE DRAWINGS

FIGS. 5, 6, 7 and 2 are four cross-sectional views of the telescopic pump shown in FIG. 1, showing four steps during an intake stroke of the telescopic pump.

DETAILED DESCRIPTION OF THE EMBODIMENTS

In this specification, "internal" defines a state of being proximate to an axis while "external" refers to a state of being distal to an axis. Arrows A and B indicate two opposite directions of travel.

Figure 1:
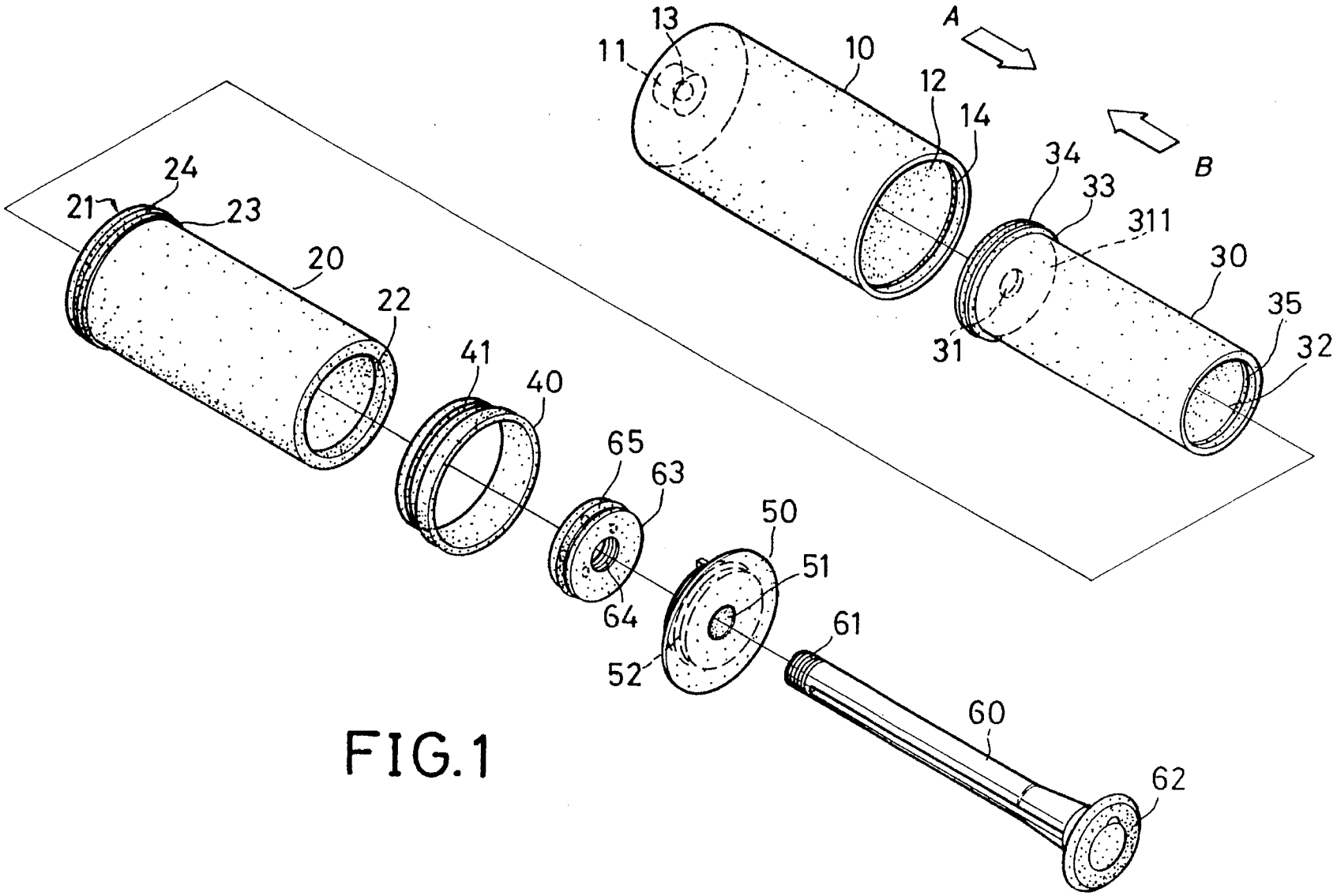
FIG. 1 is an exploded view of a telescopic pump in accordance with a first embodiment of the present invention.

Referring to FIG. 1, in accordance with a first embodiment of the present invention, a telescopic pump has a first cylinder 10 which has a first end defining a nozzle 11 and a second end defining an opening 12. A ball 13 is retained in the nozzle 11 by means of a slotted disk (not numbered) which is formed in the nozzle 11. The nozzle 11, the slotted disk and the ball 13 together form a check valve. The check valve will not be further described as it is well known. A groove 14 is circumferentially defined in the internal surface of the first cylinder 10.

A second cylinder 20 has a first end defining an opening 21 and a second end defining an opening 22. A piston 23 is circumferentially formed on the external surface at the first end of the second cylinder 20. A sealing ring 24 is received in a groove (not numbered) which is circumferentially defined in the piston 23. A limit 25 is circumferentially formed, in the form of an annular flange, on the internal surface at the second end of the second cylinder 20.

A third cylinder 30 has a first end defining an opening 31 through a first end thereof and a second end defining an opening 32. A piston 33 is circumferentially formed on the external surface at the first end of the third cylinder 30. A sealing ring 34 is received in a groove (not numbered) which is circumferentially defined in the piston 33. A groove 35 is circumferentially defined in the internal surface at the second end of the third cylinder 30.

A limit 40 is in the form of a sleeve. The external surface of the limit 40 has a stepped form, i.e., it has a first section with a smaller diameter and a second section with a larger diameter. An annular flange 41 is circumferentially formed on the first section of the external surface of the limit 40.

The third cylinder 30 is inserted in the direction of an arrow A into the second cylinder 20. The limit 25 keeps the piston 33 from moving in the direction of arrow A out of the second cylinder 20.

The second cylinder 20 is inserted in the direction of an arrow B into the first cylinder 10. The first section of the limit 40 is inserted in the direction of arrow B into the second end of the first cylinder. The second section of the limit 40 abuts the second end of the first cylinder 10 so as to keep the limit 40 from further moving in the direction of arrow B into the first cylinder 10. In this position, the annular flange 41 is engaged in the groove 13 in order to keep the limit 40 from moving in the direction of arrow A out of the first cylinder 10. The limit 40 keeps the piston 23 from moving in the direction of arrow A out of the first cylinder 10. The first end of the first cylinder 10 keeps the piston 23 from moving in the direction of arrow B out of the first cylinder 10. Thus, the piston 23 is retained in the first cylinder 10. As a result, the piston 33 is retained in the second cylinder 20.

A limit 50 defines a hole 51 therethrough. The limit 50 has a cover and a plug which axially projects from the cover. An annular flange 52 is formed on the external surface of the plug of the limit 50.

A stem 60 has a thread 61 which is formed at a first end thereof and a button 62 which is formed at a second end thereof. A hole is defined axially through a piston 63. A thread 64 is formed on an internal surface of the piston 63. A sealing ring 65 is received in a groove (not numbered) which is circumferentially defined in the external surface of the piston 63. The piston 63 is identical to the piston which is discussed in BACKGROUND OF INVENTION, therefore, further details thereof will not be given.

The stem 60 is inserted through the hole 51 in the direction of arrow B. The thread 61 is engaged with the thread 64 in order to combine the stem 60 and the piston 63. The piston 63 is inserted in the direction of arrow B into the third cylinder 30. The plug of the limit 50 is inserted in the direction of arrow B into the third cylinder 30. The annular flange 52 is engaged in the groove 35. The piston 63 is retained in the third cylinder 30 by means of the limit 50.

As mentioned in the BACKGROUND OF INVENTION, grease may be provided on the sealing rings 24, 34 and 65 for sealing purposes. Thus, a chamber is defined and sealed in the cylinders 10, 20 and 30 between the first end of the first cylinder 10 and the piston 63.

Figure 2:
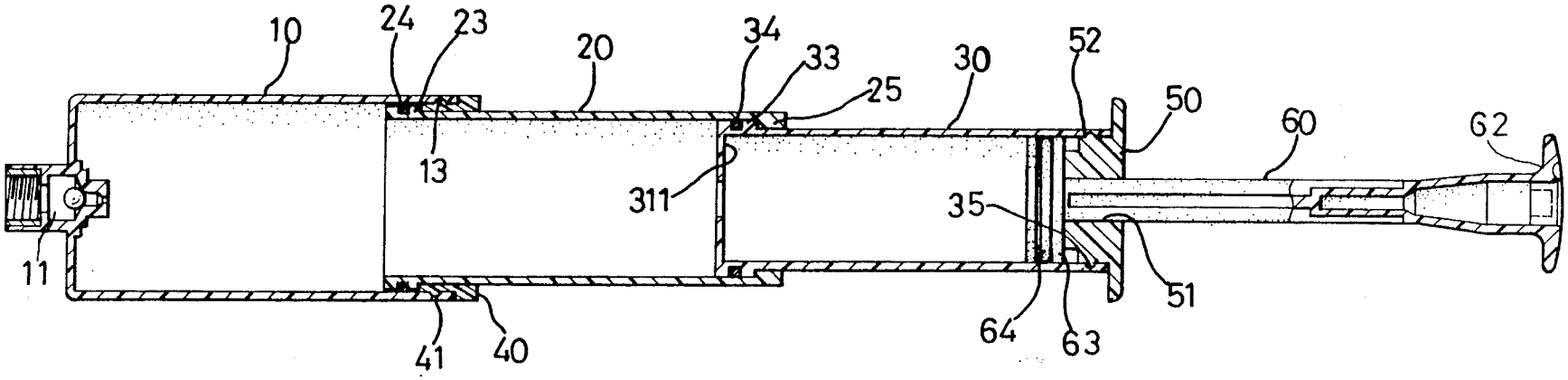
FIGS. 2 through 5 are four cross-sectional views of the telescopic pump shown in FIG. 1, showing four steps during a compression stroke of the telescopic pump.

Referring to FIG. 2, the telescopic pump is retained in a completely extended position so that the chamber has the maximum volume. By pushing the button 62 of the stem 60, the piston 63 is pushed into third cylinder 30. The volume of the chamber is reduced so that air is pumped out of the telescopic pump via the nozzle 11.

Figure 3:
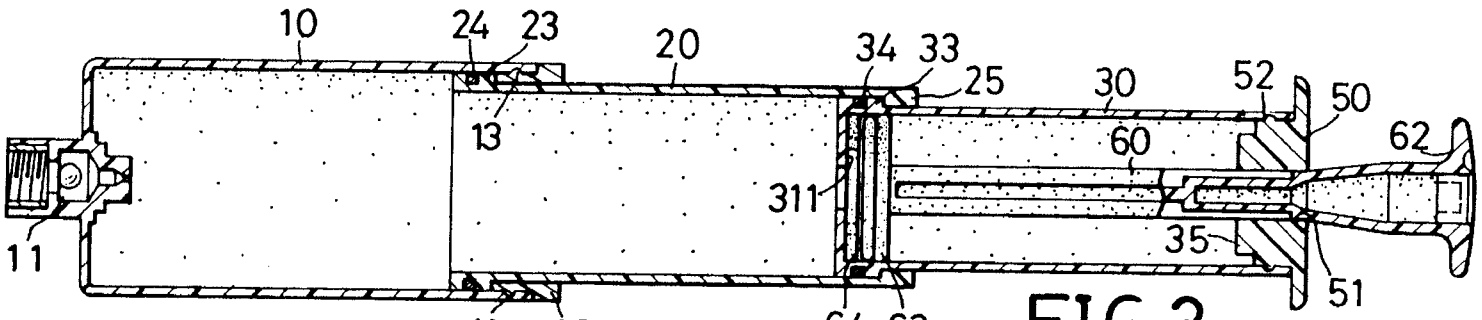

Referring to FIG. 3, the piston 63 is pushed against the first end of the third cylinder 30. By further pushing the button. 62 of the stem 60, the third cylinder 30 is pushed into the second cylinder 20. The chamber is further compressed so that more air is pumped out of the telescopic pump via the nozzle 11.

Figure 4:
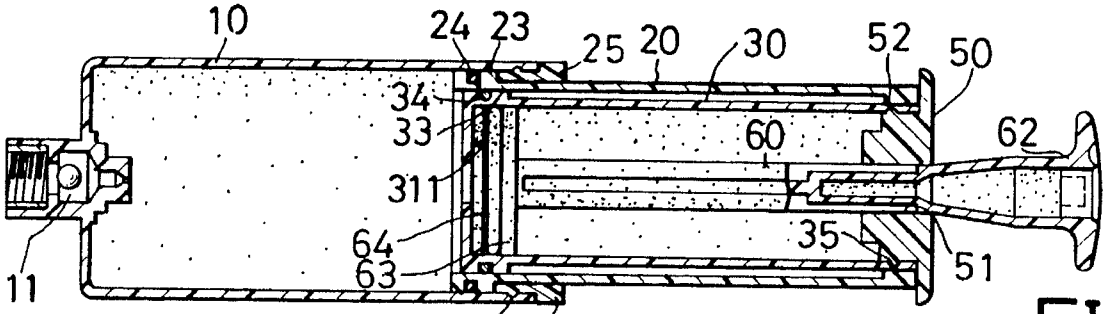

Referring to FIG. 4, the first end of the third cylinder 30 is pushed against the first end of the second cylinder 20. By further pushing the button 62 of the stem 60, the second cylinder 20 is pushed into the first cylinder 10. The chamber is further compressed so that more air is pumped out of the telescopic pump via the nozzle 11.

Figure 5:
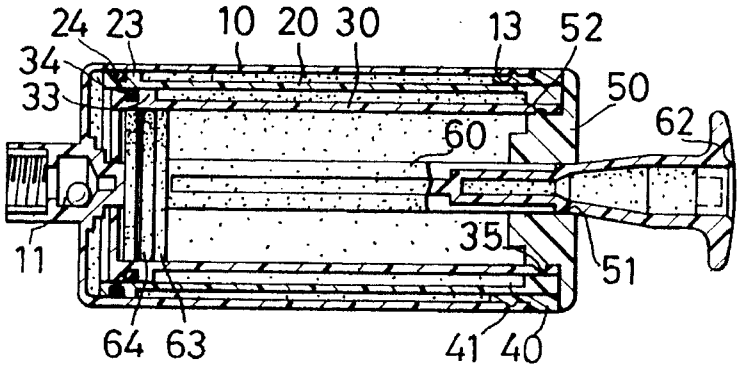
Figure 7:
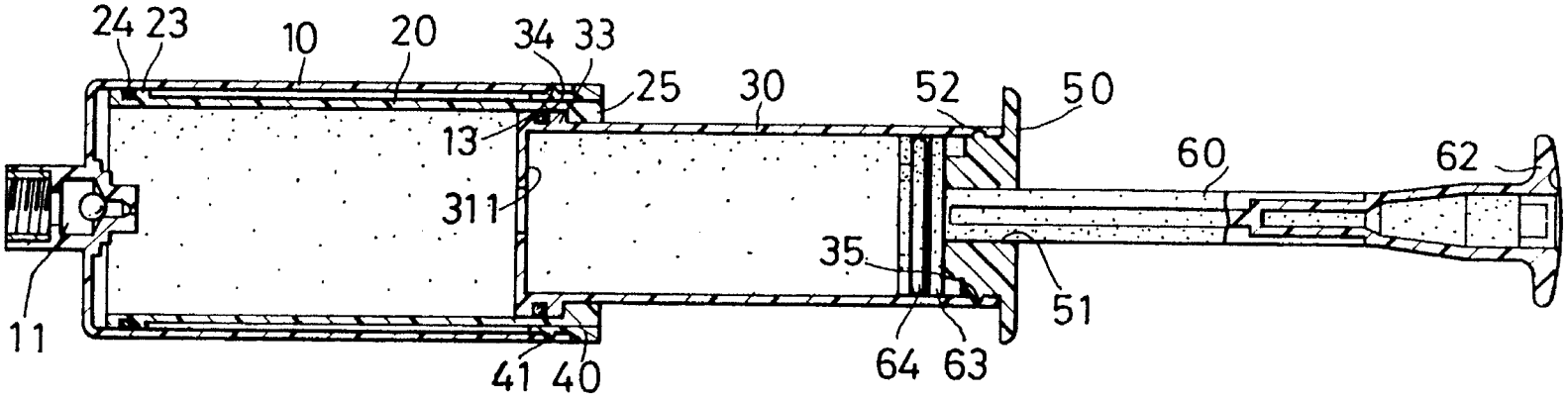
Figure 6:
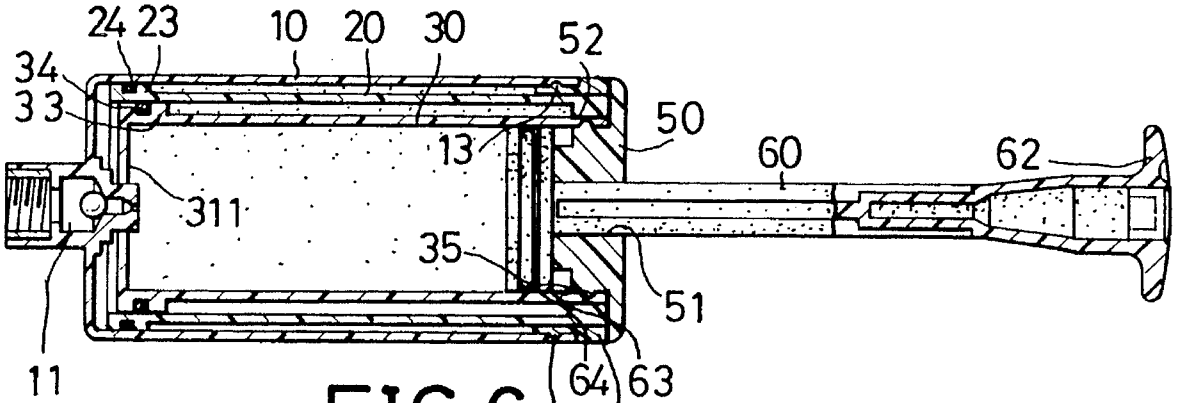

Referring to FIG. 5, the telescopic pump is shown in a completely retracted position. In the present position, the telescopic pump can be easily stored.

Referring to FIGS. 5, 6, 7 and 2, four steps during an intake stroke of the telescopic pump are shown. It is obvious that much air can be drawn into the telescopic pump.

Figure 8:
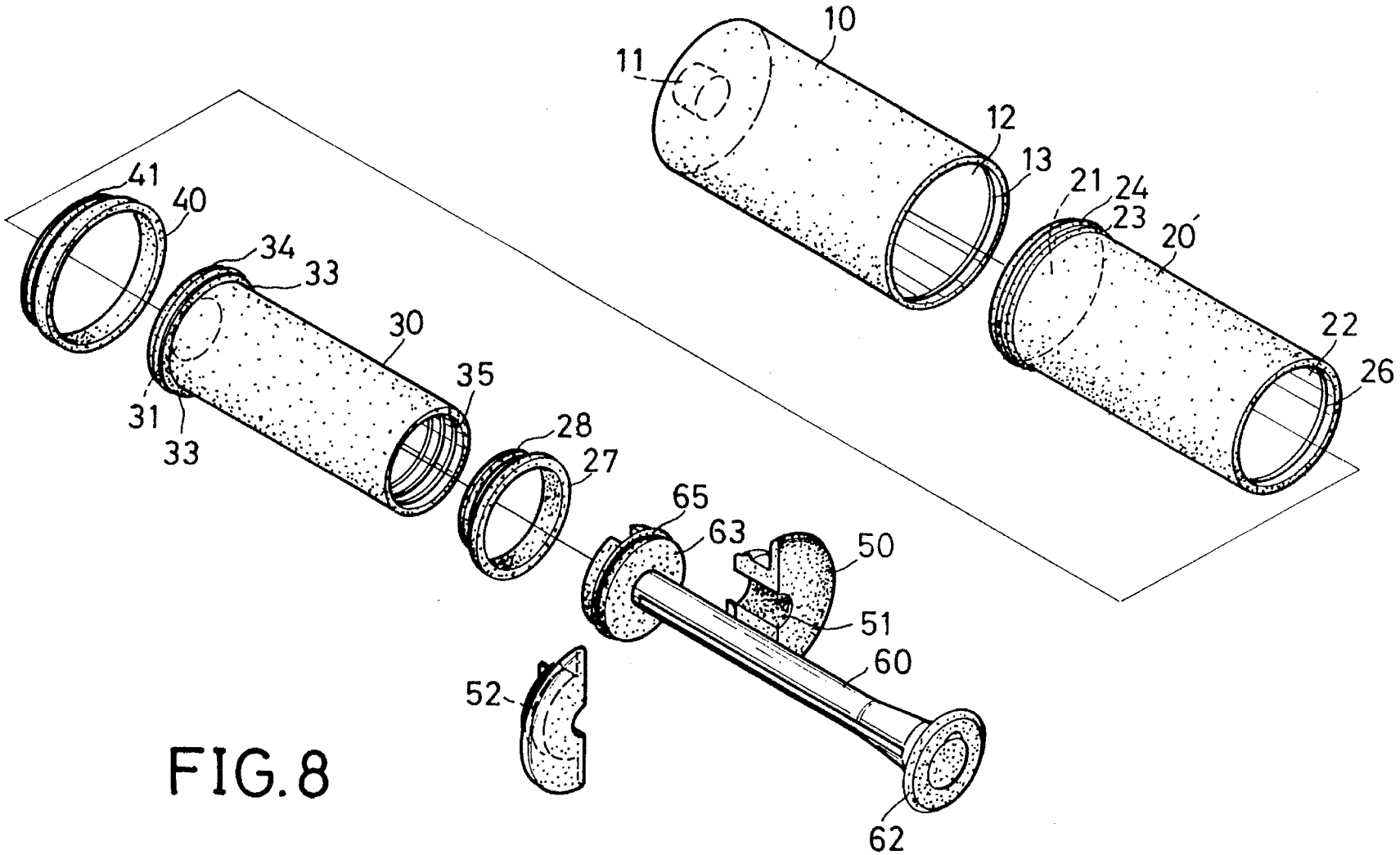
FIG. 8 is an exploded view of a telescopic pump according to a second embodiment of the present invention.

Referring to FIG. 8, a telescopic pump in accordance with a second embodiment of the present invention will be illustrated by describing a plurality of points which distinguish the second embodiment from the first embodiment. The limit 25 is replaced with a combination of a groove 26, a limit 27 and an annular flange 28. The groove 26 is defined in the internal surface at the second end of the second cylinder 20'. The limit 27 is similar to the limit 40 while the annular flange 28 is similar to the annular flange 41. The limit 27 is attached to the second end of the second cylinder 20' by engaging the annular flange 28 in the groove 26. The piston 33 is thus retained in the second cylinder 20'. The stem 60 and the piston 63 are combined as an integral element. The limit 50 is replaced with a limit 50' which consists of two individual halves. The halves of the limit 50' can be separated from each other so that they can be mounted on the stem 60. The halves of the limit 50' are then combined to form an element similar to the limit 50.

While the present invention has been explained in relation to its embodiments, it is to be understood that variations thereof will be apparent to those skilled in the art upon reading the present specification. Therefore, the appended claims are intended to cover all such variations.

What is claimed is:

1. A telescopic pump comprising:

a first cylinder comprising a first end defining a nozzle and a second end defining an opening;

a check valve being received in the nozzle;

a second cylinder being telescopically received in the first cylinder, and comprising a first end defining a first opening, a second end defining a second opening and a piston formed about the first end thereof;

a first limit being attached to the second end of the first cylinder for retaining the piston of the second cylinder in the first cylinder;

a third cylinder being telescopically received in the second cylinder, and comprising a first end defining a first opening, a second end defining a second opening and a piston formed about the first end thereof;

a second limit being attached to the second end of the second cylinder for retaining the piston of the third cylinder in the second cylinder;

a stem;

a piston being linked to the stem and received in the third cylinder, and comprising first and second disks spaced from each other, the first disk defining a plurality of through holes;

a sealing ring being slidably mounted between the first and second disks of the piston linked to the stem; and a third limit being attached to the second end of the third cylinder for retaining the piston, which is linked to the stem, in the third cylinder.

2. A telescopic pump in accordance with claim 1 wherein the second limit is formed at the second end of the second cylinder.

3. A telescopic pump in accordance with claim 1 wherein the third limit consists of two semi-annular halves between which the stem is slidably inserted.

4. A telescopic pump in accordance with claim 1 comprising a sealing ring received in a groove circumferentially defined in the piston of the second cylinder.

5. A telescopic pump in accordance with claim 1 comprising a sealing ring received in a groove circumferentially defined in the piston of the third cylinder.

* * * * *